US009482395B2

(12) United States Patent
Ellingson et al.

(10) Patent No.: US 9,482,395 B2
(45) Date of Patent: Nov. 1, 2016

(54) LED LUMINAIRE

(71) Applicant: Atlas Lighting Products, Inc., Burlington, NC (US)

(72) Inventors: Scott T. Ellingson, Graham, NC (US); Henry Skoczylas, Wall, NJ (US)

(73) Assignee: Atlas Lighting Products, Inc., Burlington, NC (US)

( * ) Notice: Subject to any disclaimer, the term of this patent is extended or adjusted under 35 U.S.C. 154(b) by 63 days.

(21) Appl. No.: 14/564,152

(22) Filed: Dec. 9, 2014

(65) Prior Publication Data

US 2015/0109782 A1 Apr. 23, 2015

Related U.S. Application Data

(63) Continuation of application No. 14/238,867, filed as application No. PCT/US2012/028527 on Mar. 9, 2012.

(60) Provisional application No. 61/524,729, filed on Aug. 17, 2011.

(51) Int. Cl.
*F21K 99/00* (2016.01)
*F21V 13/12* (2006.01)
(Continued)

(52) U.S. Cl.
CPC . *F21K 9/50* (2013.01); *F21K 9/10* (2013.01); *F21S 8/033* (2013.01); *F21V 13/02* (2013.01);
(Continued)

(58) Field of Classification Search
CPC .. F21V 15/011; F21V 29/004; F21V 29/507; F21V 13/02; F21V 29/70; F21V 13/12; F21V 23/005; F21S 8/033; F21S 8/03; F21K 9/50; F21Y 2105/001
USPC ..... 362/294, 249.02, 373, 307
See application file for complete search history.

(56) References Cited

U.S. PATENT DOCUMENTS 5,530,628 A * 6/1996 Ngai ..... 362/33
6,422,709 B1 * 7/2002 Panagiotou ..... 362/16
(Continued)

FOREIGN PATENT DOCUMENTS

CA 2647428 5/2010
EP 2019250 1/2009
(Continued)

OTHER PUBLICATIONS

International Search Report and Written Opinion for PCT/US2012/028527; Jul. 5, 2012; 13 pgs.
(Continued)

*Primary Examiner* — Diane Lee
*Assistant Examiner* — Mitchell Errett
(74) *Attorney, Agent, or Firm* — Womble Carlyle Sandridge & Rice, LLP

(57) ABSTRACT

An LED luminaire includes a thermal management system and features minimal glare while allowing for use of traditional luminaire housing. The luminaire of the depicted embodiments includes a luminaire housing, an LED light module, an LED driver, a diffuser, and reflectors. The LED light module includes at least one LED array, a primary thermal interface, and a secondary thermal interface. These thermal interfaces, particularly when used in conjunction with a conductive housing, allow for optimal thermal management by utilizing both natural convection and conduction to remove the heat from inside the luminaire into the surrounding air. Additionally, in certain embodiments, the position of the LED arrays within the housing in combination with the reflector design creates an optical path resulting in an indirect light source that minimizes glare, while providing a uniform distribution of light, unlike traditional LED luminaires.

14 Claims, 7 Drawing Sheets

(51) Int. Cl.

| | |
|---|---|
| ***F21V 23/00*** | (2015.01) |
| ***F21V 29/85*** | (2015.01) |
| ***F21V 29/00*** | (2015.01) |
| ***F21V 13/02*** | (2006.01) |
| ***F21V 29/507*** | (2015.01) |
| ***F21V 29/70*** | (2015.01) |
| *F21V 15/01* | (2006.01) |
| *F21S 8/00* | (2006.01) |
| *F21Y 101/02* | (2006.01) |
| *F21Y 105/00* | (2016.01) |
| *F21V 3/04* | (2006.01) |

(52) U.S. Cl.

CPC ..... *F21V 13/12* (2013.01); *F21V 23/005* (2013.01); *F21V 29/004* (2013.01); *F21V 29/507* (2015.01); *F21V 29/70* (2015.01); *F21V 29/85* (2015.01); *F21S 8/00* (2013.01); *F21S 8/03* (2013.01); *F21V 3/049* (2013.01); *F21V 15/011* (2013.01); *F21Y 2101/02* (2013.01); *F21Y 2105/001* (2013.01)

(56) References Cited

U.S. PATENT DOCUMENTS

| | | | | |
|---|---|---|---|---|
| 6,848,819 | B1 | 2/2005 | Arndt et al. | |
| 8,038,321 | B1 * | 10/2011 | Franck et al. | 362/249.02 |
| 2005/0007025 | A1 * | 1/2005 | Gauna | 315/149 |
| 2005/0180142 | A1 | 8/2005 | Tsai | |
| 2007/0103894 | A1 | 5/2007 | Klose | |
| 2007/0285920 | A1 * | 12/2007 | Seabrook | 362/240 |
| 2008/0278957 | A1 | 11/2008 | Pickard et al. | |
| 2009/0027887 | A1 | 1/2009 | Yamada et al. | |
| 2009/0207604 | A1 * | 8/2009 | Robotham | 362/230 |
| 2010/0157607 | A1 | 6/2010 | Venhaus | |
| 2010/0271816 | A1 * | 10/2010 | Ozeki et al. | 362/217.05 |
| 2011/0019404 | A1 | 1/2011 | Chien et al. | |
| 2011/0019416 | A1 | 1/2011 | Poissonnet et al. | |
| 2011/0031887 | A1 | 2/2011 | Stoll et al. | |
| 2011/0170298 | A1 | 7/2011 | Anaokar et al. | |
| 2013/0279167 | A1 * | 10/2013 | Wilcox et al. | 362/245 |
| 2014/0247603 | A1 * | 9/2014 | Cruz et al. | 362/311.01 |

FOREIGN PATENT DOCUMENTS

| | | |
|---|---|---|
| EP | 2133621 | 12/2009 |
| EP | 2309171 | 4/2011 |

OTHER PUBLICATIONS

Pictures of Howard MWP Series LED, E333106, known at least as early as Feb. 14, 2014, 6 pgs.

* cited by examiner

LED LUMINAIRE

PRIORITY

This application is a continuation of prior application Ser. No. 14/238,867, filed Feb. 14, 2014, which is a 371 of International Application No. PCT/US2012/028527, which claims the benefit of Provisional Application No. 61/524,729, filed Aug. 17, 2011, the contents of which are hereby incorporated by reference.

BACKGROUND OF THE INVENTION

This application is directed to a solid-state luminaire consisting of an LED luminaire that features minimal glare and optimal heat dissipation through a thermal management system and glare reduction system.

Due to the increasingly widespread quest for energy savings, light emitting diodes (LEDs) have become more and more popular in the lighting industry. LEDs are so popular because of their small size, fast on-time and quick on-off cycling, relatively cool light, and high efficiency. LEDs present challenges for luminaire manufacturers, however, with respect to heat and glare.

In contrast to most other currently available light sources, LEDs radiate very little heat in the form of infrared radiation. Waste energy is dispersed as heat through the base of the LED. Typically, LED luminaires incorporate a plurality of LEDs and the heat given off can be substantial. Overdriving an LED in high ambient temperatures may result in overheating the LED array, eventually leading to device failure. Adequate heat dissipation is desirable to maintain the long life of which LEDs are capable.

For the most part, LED luminaires deal with the heat dissipation issue in one of two ways. Some luminaires incorporate air vents and complex heat sinks, sometimes involving fins on the exterior of the housing where they are visible to the consumer and aesthetically unappealing and often requiring complicated internal housing to allow for weatherproofing. Moreover, in many cases, because the number and size of LEDs affects heat dissipation requirements, the configuration and dimensions of the finned housing vary according to the number and size of the LEDs, which increases stocking requirements, makes it more difficult to substitute fixtures if lighting needs change, and increases architectural planning considerations. Those issues create a deterrent for businesses seeking to transition from existing non-LED luminaires to the greater efficiencies provided by LEDs.

Other luminaires simply do not provide adequate thermal management. If such fixtures are used for long periods of time, heat becomes a problem resulting in a likely shortening of the LED lifetimes and potential serious color shift of the devices.

Many LED luminaires also have problems with glare and/or the production of multiple shadows, since the light exiting each individual light-emitting diode is focused forward and not diffused. Traditionally, LED arrays are positioned similarly to other lamps in luminaires, such that the light flows directly from the lamp through the face of the fixture. This positioning allows for maximum light output, but it disregards the discomfort of the resulting glare. Generally when an LED luminaire is to be used as area lighting rather than point-source lighting, the issues of glare and shadowing have been treated in the manner typical of non-LED luminaires: by incorporating reflectors behind the lamp to diffuse the light and designing the housing to allow for the reflectors. Alternatively or in addition, a diffuser may be used.

SUMMARY OF THE INVENTION

An LED luminaire in accordance with a preferred embodiment of the subject invention comprises a luminaire housing, an LED light module, an LED driver, a diffuser, and reflectors. The LED light module comprises at least one LED array, a primary thermal interface, and an optional secondary thermal interface. These thermal interfaces, particularly when used in conjunction with a heat-conductive housing, allow for optimal thermal management by utilizing natural convection to quickly remove the heat from inside the luminaire into the surrounding air. The stacked thermal interfaces of the inventive luminaire provide a dual path for quick heat dissipation. Additionally, the position of the LED arrays within the housing of certain embodiments, in combination with the reflector design, creates an optical path resulting in a light source that minimizes glare, while providing a uniform distribution of light.

DETAILED DESCRIPTION OF THE DRAWINGS

Figure 6:
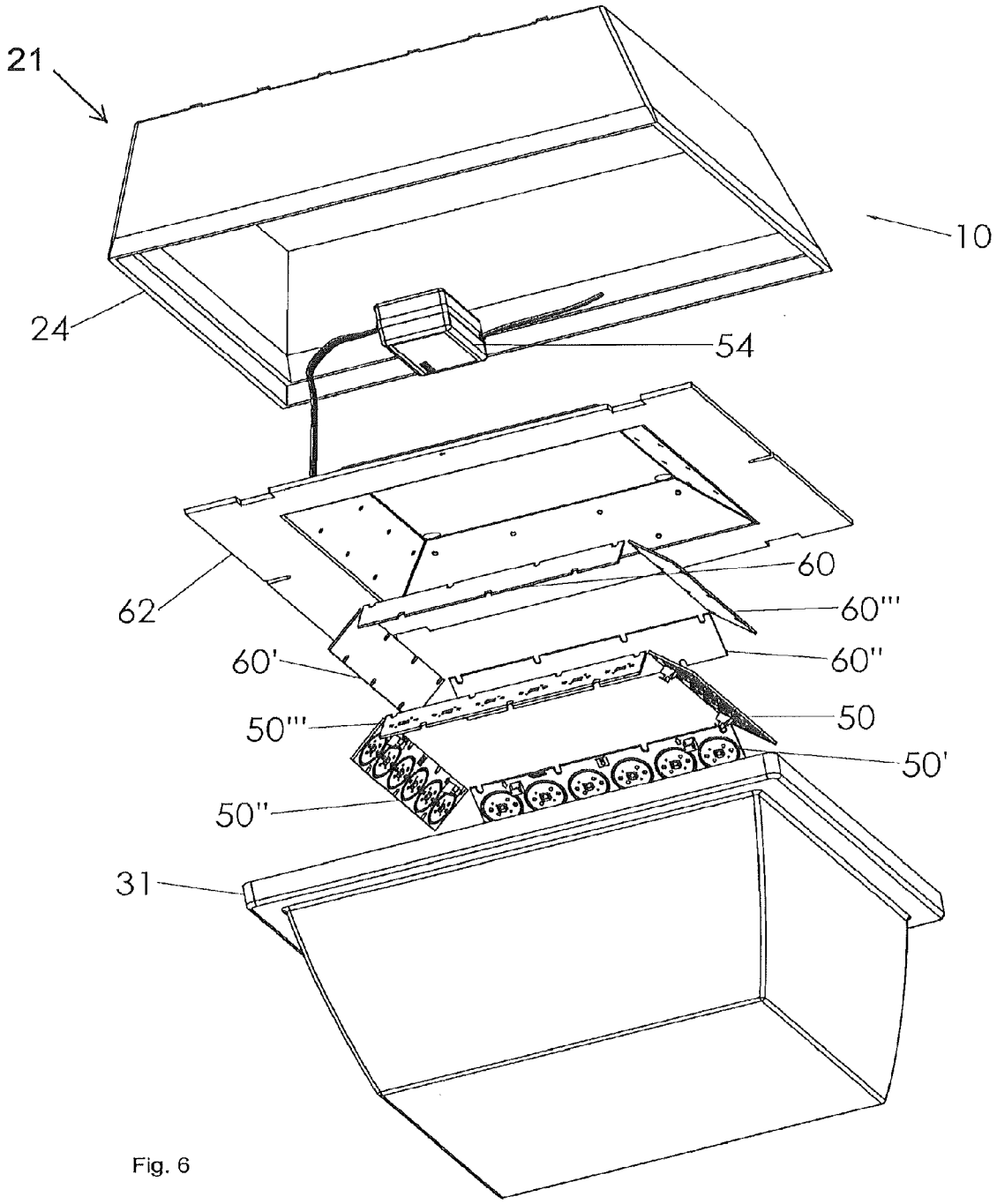
FIG. 6 depicts a disassembled, exploded view of a second luminaire embodiment.
Figure 7:
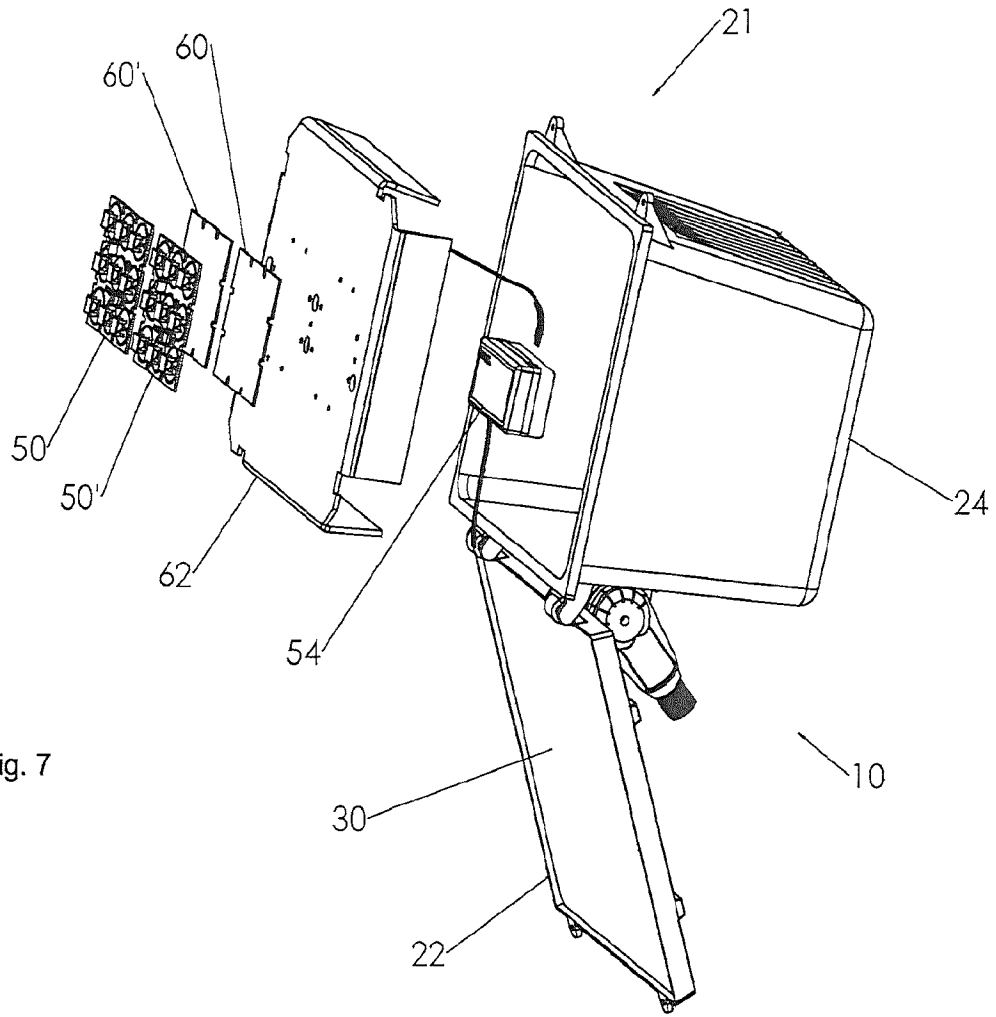
FIG. 7 depicts a disassembled, exploded view of a third luminaire embodiment.

FIGS. 1A-5 depict an LED luminaire 10 in accordance with one embodiment of the inventive thermal management system and inventive anti-glare system. FIGS. 6 and 7 depict additional embodiments of the inventive thermal management system.

As depicted in FIGS. 1A-5, the LED luminaire 10 of the depicted embodiment is a traditional wall pack unit for area lighting, which has been internally modified to provide a highly conductive thermal path to minimize LED junction temperatures. This design results in minimal temperature rise for the one or more LEDs 70, thereby insuring higher lumen maintenance and more stable correlated color temperature over the life of the product. Using a traditionally shaped and sized housing 20 offers end users the ability to enjoy the energy savings of LED technology without having to modify existing surroundings to accommodate new housing designs.

The luminaire housing 20 is preferably a wet location enclosure for protection of electrical components and connections. In the depicted embodiment, the housing consists of two parts, a back housing 24 and a front face frame 22. The front face frame 22 has an aperture 25 and a top side 26. The front face frame 22 may be connected to the back housing 24 by securing fasteners 27, 27', 28, 28' with pins 29, 29'. It is preferred that the back housing 24 and front face frame 22 be of die cast aluminum, but the back housing 24 and/or the front face frame 22 could be manufactured from other materials or in other ways. Aluminum is the presently preferred material because it works well for the die casting process, and it also is lower in cost than other conventionally available alternatives, which include zinc, Magnesium, and copper. Aluminum is further preferred due to its high thermal conductivity, an important aspect to assist in heat dissipation.

The back housing 24 may be used as the primary means for mounting the luminaire 10 to the desired location. In the depicted embodiment, it also houses the LED driver 54 and main reflector 42.

The front face frame 22 may be used as the means to mount a diffuser 30 and left and right side reflectors 44, 46 within the luminaire 10. The frame 22 further acts as a heat transfer mechanism to the exterior environment and provides the necessary mounting angle for the LED module 100 (described below) to achieve the preferred light distribution to minimize glare.

The diffuser 30 is a secondary optical interface that, in combination with the positioning of the LED module 100, may be used to redirect the light in ways that keep the light out of the region of high angle glare. The diffuser 30 may be a borosilicate prismatic glass diffuser, prismatic plastic, or flat textured tempered glass. Using diffuser film is another alternative. Borosilicate glass provides a high level of diffusion, which is important in regards to diffusing the light emitted from the LED 70 on the LED arrays 50, 50', which is aptly described as "point source" light. Prisms, which have been designed into the diffuser, are used to redirect the light emitted from the LED light source. The prisms are molded into the glass in a way that the angles cut in the glass on the inside of the fixture are generally perpendicular to those on the outside. The angles are formed in a way to create multiple optical lensing elements to create a diffusing effect for the LEDs. Since this diffuser is not directly dependent on the position or size of the chip(s) in the LEDs, nor the lens design used in the LEDs, a wide range of LEDs from many LED manufacturers can be used in the inventive device.

As already noted above, the LED module 100 is mounted to the top side 26 of the housing 20. This location is a component of the thermal management system as part of how the system utilizes natural convection. The LED module 100 in the depicted embodiment comprises of three main parts—one or more LED arrays 50, 50', one or more primary thermal interfaces 60, 60', and a secondary thermal interface 62. The LED arrays 50, 50' are printed circuit boards 52 containing one or more LEDs 70. Any shape or number of LEDs 70 may be used on the LED arrays 50, 50'. Further, the circuit board 52 could use multi-chip LEDs 70, use single or multi-array configurations, or contain secondary optics placed in conjunction with the LEDs to modify the resulting light distribution.

Figure 1B:
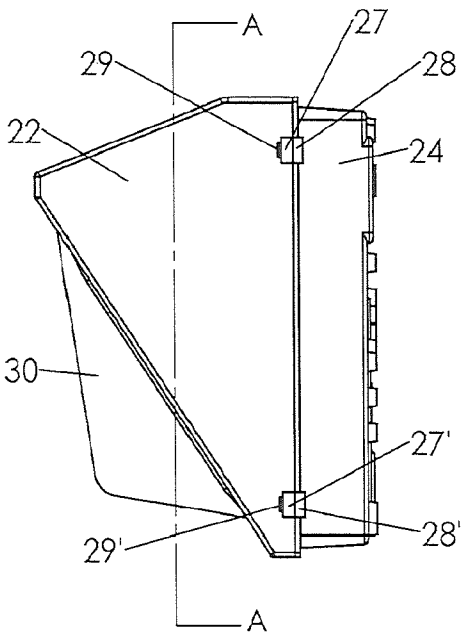
FIGS. 1A and 1B are assembled views of an LED luminaire in accordance with one embodiment of the thermal management system and of the anti-glare system.
Figure 1A:
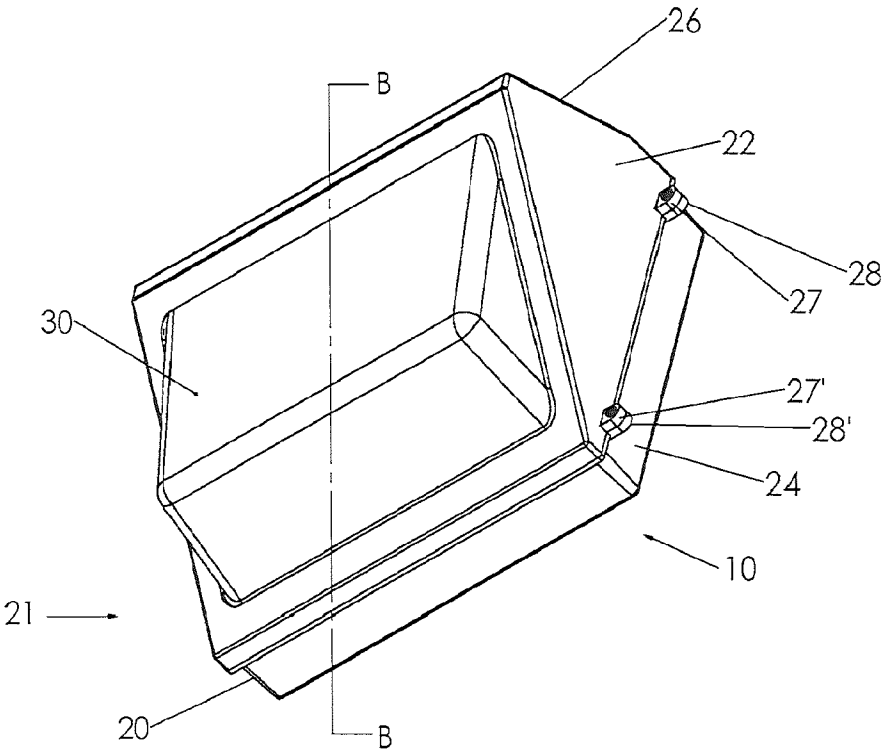
Figure 2:
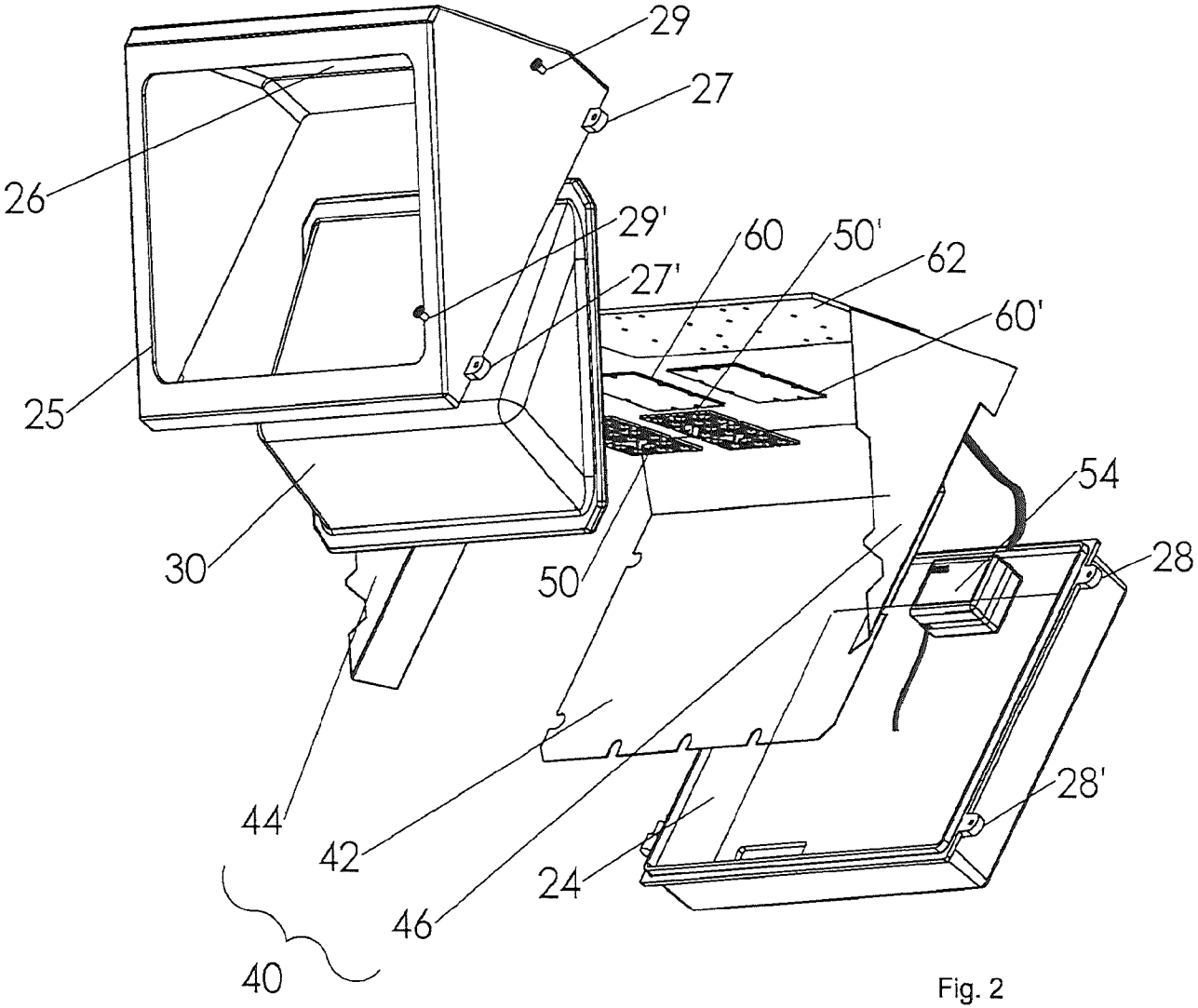
FIG. 2 depicts a disassembled, exploded view of the luminaire embodiment depicted in FIGS. 1A-1B.
Figure 3:
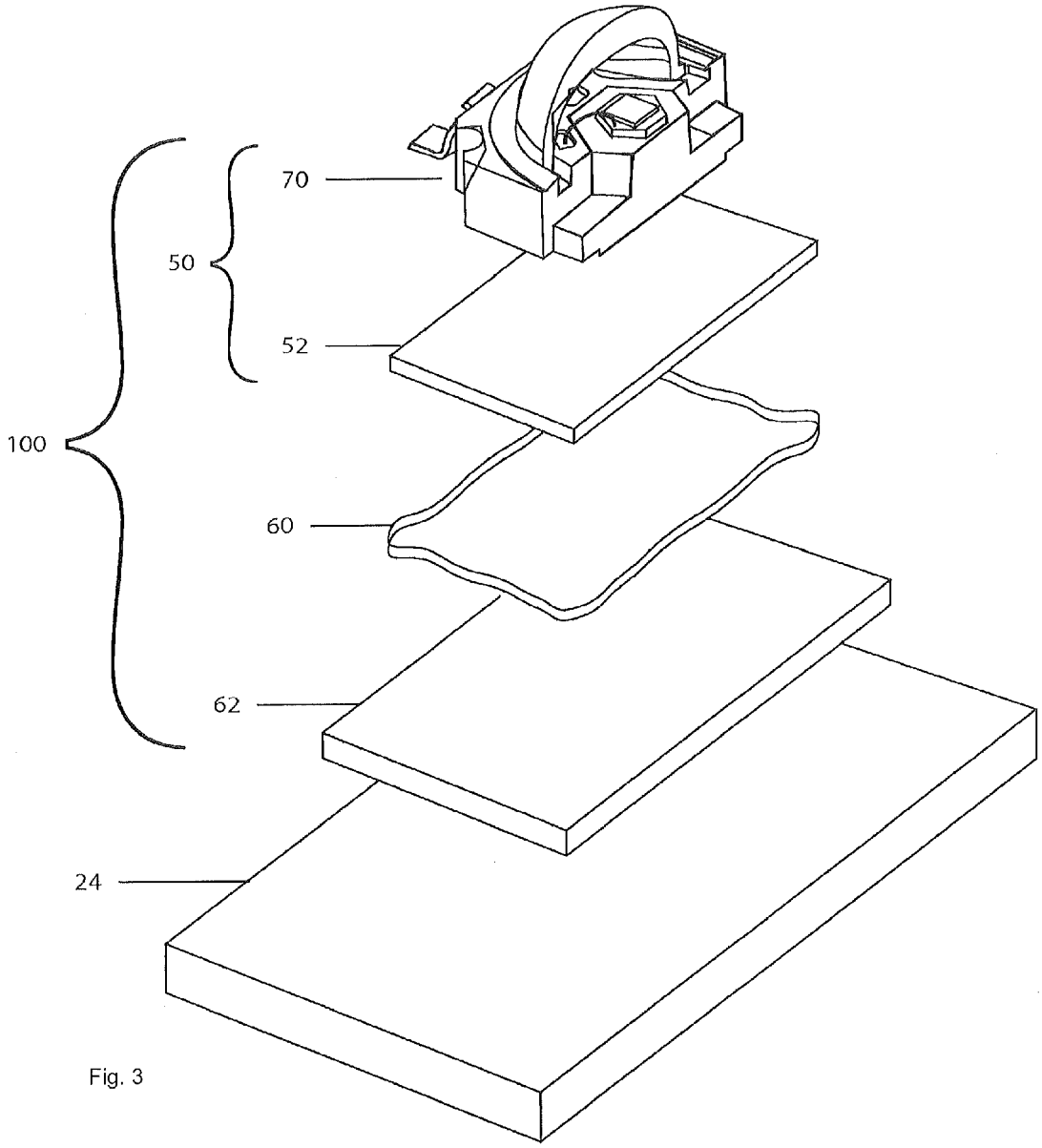
FIG. 3 depicts an exploded, cutaway view of an embodiment of an LED module and housing.

As shown more specifically in FIG. 3, the inventive thermal management system allows for optimum heat dissipation through a multi-layer heat sink. An LED array 50 is comprised of an LED 70 and printed circuit board (not separately shown). When activated, the LED 70 generates heat at its base. This inventive thermal management system utilizes both natural convection and conduction first by positioning the LED 70 so that the heat in its base is directed generally upward. Accordingly, the heat of the LED 70 first passes upward through the board 52. To allow for the most efficient heat dissipation, the board 52 may have a metal core, such as aluminum or copper.

Referring back to FIGS. 1A, 1 B, and 2, the heat then continues generally upward, passing through the primary thermal interfaces 60, 60'. These interfaces 60, 60' at least partially fill the gaps created when mounting the LED arrays 50, 50' to the secondary thermal interface 62 or to the front face frame 22 and are generally the same size as the arrays 50, 50'. The primary interfaces 60, 60' may be thermally conductive gap filler, such as an ultra soft acrylic elastomer, or, in the alternative, thermal grease, thermal tape, thermal adhesive, or some other material suitable to create a thermal path for heat dissipation. The main requirement is to use materials that are more heat-conductive than air.

The secondary thermal interface 62 as shown in the embodiments depicted in FIGS. 1A-5 provides for a continued upward conduction path as well as a secondary, substantially horizontal path for heat dissipation. In the embodiment shown, the secondary thermal interface 62 is mounted to the front face frame 22 and may be made of aluminum. Other suitable materials, such as copper or other materials more heat-conductive than the ambient air, may be used in the alternative. Greater heat conductivity will improve performance. This interface 62 provides a direct path for heat dissipation from the LED circuit board 52 to the housing 24, which then dissipates the heat to the ambient air. In addition, a second path is provided from the LED circuit board 52 to the interface 62 that provides a broad surface to dissipate heat to the air enclosed by the housing 20. This air, in turn, conducts the heat to the housing 20 via natural convection from whence it is conducted to the air external to the housing 20. Due to the effectiveness of this dual path for heat dissipation, there is no need for vents, fins, or complex weatherproofing.

Additionally, using the secondary thermal interface 62 for mounting the LED arrays 50, 50' provides an easily modified mounting solution rather than attaching the LED arrays 50, 50' directly to the housing 20. If the LED arrays 50, 50' were mounted directly to the housing 20, any change in the size or type of arrays 50, 50' would potentially mean modifying the housing 20 and, thus, the die cast molding. Changing hole sizes or positions in the secondary thermal interface 62 is much easier and can be accomplished in less time and at lower cost.

FIGS. 6 and 7 depict alternate embodiments of the inventive luminaire 10. FIG. 6 depicts an embodiment of the inventive luminaire 10 in vandal-resistant housing. FIG. 7 depicts an embodiment of the inventive luminaire 10 in floodlight housing. Each comprises a back housing 24, one or more LED arrays 50, 50', 50", 50'", LED driver 54, one or more primary interfaces 60, 60', 60", 60'", and a secondary thermal interface 62. The floodlight FIG. 7 also includes a front face frame 22, and the vandal-resistant FIG. 6 includes a front face diffuser 31. As with the embodiment depicted in FIGS. 1A-5, these alternate embodiments also utilize a combination of natural convection and conduction. With the one or more LED arrays 50, 50', 50", 50'", stacked with one or more primary interfaces 60, 60', 60", 60'" and a secondary thermal interface 62, and then mounted to the back housing 24, both a conductive and convective thermal path to the housing are provided. Optionally, the secondary thermal interfaces 62, 62' may also serve to reflect the light produced by the LED arrays 50, 50', providing a stronger light output.

As shown in FIGS. 1A-5 of the first embodiment, the reflector system 40, shown in the depicted embodiment as three separate reflectors 42, 44, 46, is used to redirect the light output from the LED arrays 50, 50' into the prismatic glass of the diffuser 30. The reflector system 40 may be manufactured of formed aluminum, steel, or other material suitable for the purpose and finished with a suitable optical coating (e.g., polished, reflective paint, etc.). The reflectors 42, 44, 46 may be combined into a single reflector, two reflectors, or other combinations of reflectors to achieve a similar result.

Figure 4:
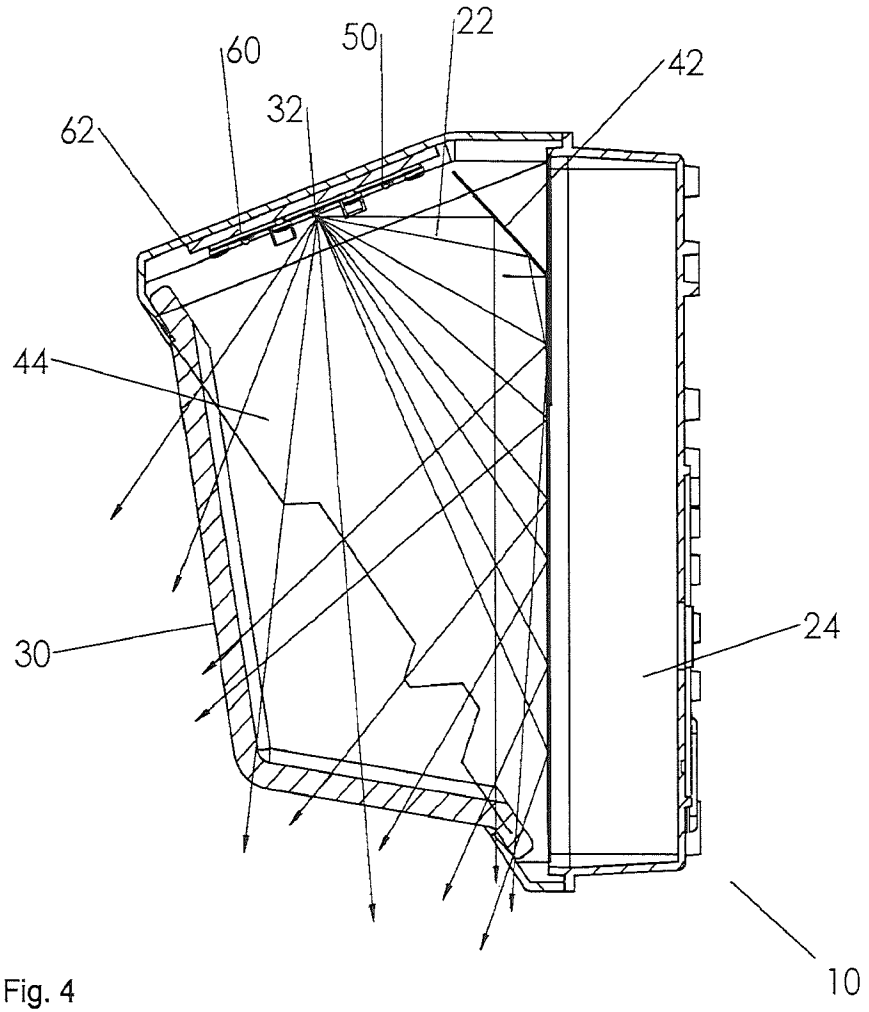
FIG. 4 is a cross sectional view of the luminaire embodiment depicted in FIG. 1B at the line shown.
Figure 5:
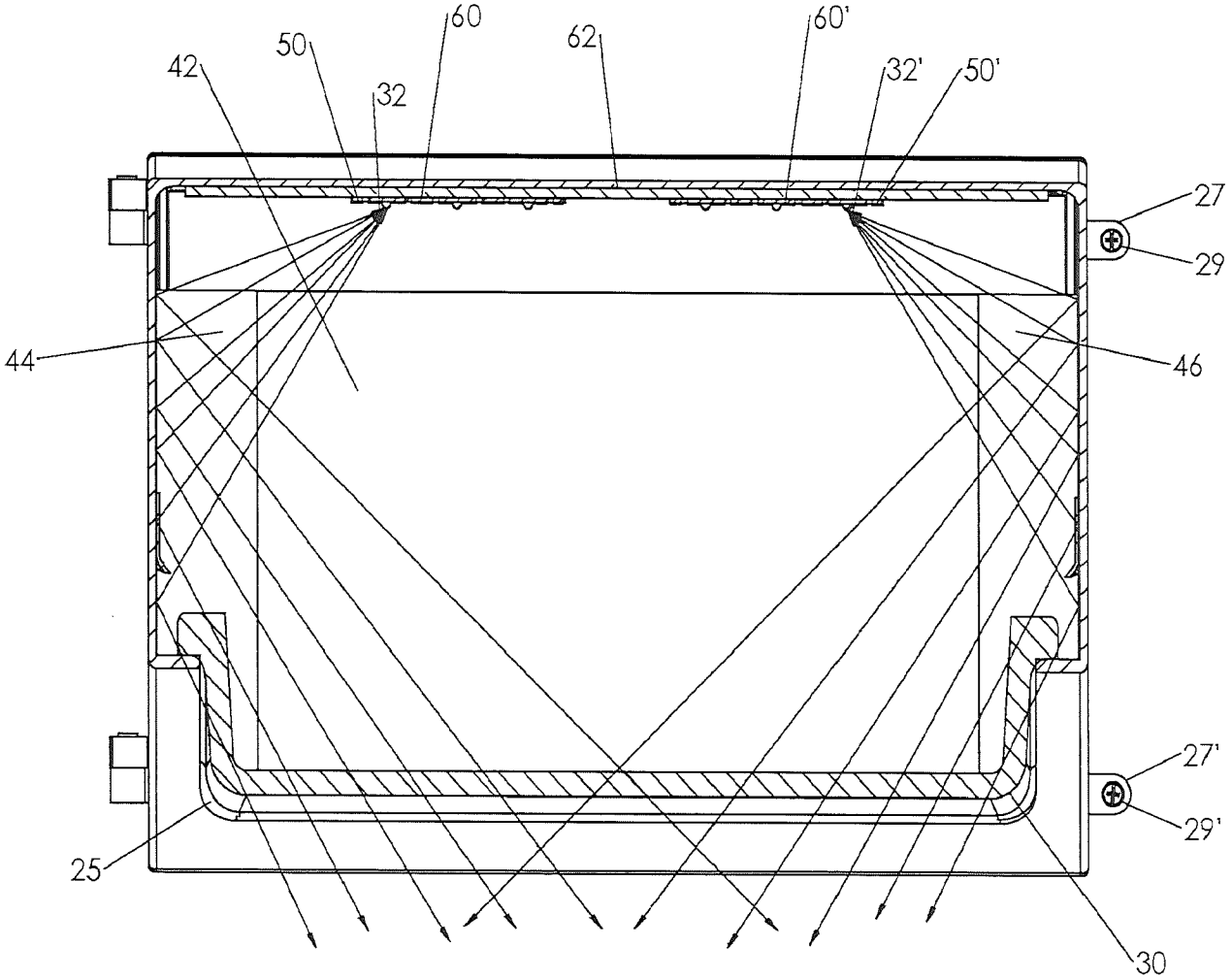
FIG. 5 is a cross sectional front view of the luminaire embodiment depicted in FIG. 1A at the line shown.

As specifically shown in FIGS. 4 and 5 of the first embodiment, the position of the one or more LED arrays 50, 50' on the top side 26 of the luminaire 10 in combination with the reflector system 40 creates an optical path resulting in an indirect light source that minimizes glare, while providing a uniform distribution of light, unlike traditional LED luminaires. Specifically, the LED arrays 50, 50' are secured to the top side 26 of the luminaire 10. The one or more LEDs 70 on the LED arrays 50, 50' have a distribution pattern such that they produce light in a cone 32, 32' at approximately 120 degrees from the orthogonal. Because the arrays 50, 50' are aimed substantially toward the bottom portion 21 of the housing 20, they deliver the majority of the light at lower angles. The reflector system 40 also directs the resulting light from the arrays 50, 50' toward the bottom portion of the housing. The prisms within the diffuser 30 then redirect the light exiting the fixture such that the resultant light in the glare zone (80 to 90 degrees from the downward direction) is minimized. While this combination does cause some loss in light output, the lack of glare from the luminaire 10 is a valuable and so far underappreciated advantage.

The foregoing details are exemplary only. Other modifications that might be contemplated by those of skill in the art are within the scope of this invention, and are not limited by the examples illustrated herein.

What is claimed is:

1. An LED (light emitting diode) luminaire having an anti-glare system, comprising:

a. a luminaire housing having a top wall, a bottom wall, a back wall extending between the top wall and the bottom wall, and a light emission aperture opposite the back wall;

b. an LED light module, comprising an array of LEDs mounted on a circuit board, the LED light module is attached to the top wall of the housing such that a resulting light from the array of LEDs is aimed substantially toward the bottom wall of the housing;

c. at least one reflector within the luminaire housing; and d. a prismatic diffuser disposed within the light emission aperture that covers the LED light module such that the resulting light exits the luminaire at angles below 80 degrees as measured from a downward vertical of the resulting light wherein the diffuser comprises a first portion opposite the back wall, and a second portion opposite the top wall, wherein the second portion is angled with respect to the first portion, wherein at least some of the light emitted from the LED light module strikes the reflector, at least some passes directly through the first portion of the diffuser, and at least some passes directly through the second portion of the diffuser.

2. The LED luminaire of claim 1 in which the diffuser is selected from the group consisting of a borosilicate prismatic glass diffuser or prismatic plastic.

3. The LED luminaire of claim 1 in which the housing is selected from the group consisting of zinc, aluminum, magnesium, and copper.

4. An LED (light emitting diode) luminaire having a dual means for heat dissipation and an anti-glare system, comprising:

a. a luminaire housing having at least a front face with an aperture, a back portion opposite the front face, a top side extending between the front face and the back portion, and a lower portion opposite the top side;

b. an LED light module attached to the housing and comprising i. at least one LED array comprising a plurality of LEDs, the LED light module attached to the top side of the housing and oriented in a manner such that when the LED light module is operated to provide light, a resulting light from the LED light module is aimed substantially toward the lower portion of the housing;

ii. at least one first thermal interface, and iii. at least one second thermal interface, wherein at least a portion of the at least one first thermal interface is interposed between the at least one LED array and the at least one second thermal interface, and wherein the at least one second thermal interface is interposed between the at least one first thermal interface and the housing;

c. at least one reflector located within the luminaire housing and positioned to direct the resulting light substantially toward the lower portion of the housing; and d. a prismatic diffuser disposed within the aperture of the front face and covering the LED light module such that the resulting light exits the luminaire at angles below 80 degrees as measured from a downward vertical of the resulting light, wherein the diffuser comprises a first portion along the front face, and a second portion opposite the top side, wherein the second portion is angled with respect to the first portion, wherein at least some of the light emitted from the LED light module strikes the reflector, at least some passes directly through the first portion of the diffuser, and at least some passes directly through the second portion of the diffuser.

5. The LED luminaire of claim 4 in which at least one of the at least one first thermal interface is selected from the group consisting of an acrylic elastomer, thermal grease, thermal tape, or thermal adhesive.

6. The LED luminaire of claim 4 in which the at least one second thermal interface is selected from the group consisting of copper or aluminum.

7. The LED luminaire of claim 4 in which the housing is selected from the group consisting of zinc, aluminum, magnesium, and copper.

8. The LED luminaire of claim 4 further comprising at least one secondary optic placed in conjunction with the at least one LED array to modify the light distribution emitted by the at least one LED array.

9. The LED luminaire of claim 4, wherein the LED light module comprises a circuit board having a metal core.

10. The LED luminaire of claim 4 comprising a plurality of LED light modules.

11. The LED luminaire of claim 4, wherein the reflector comprises a substantially planar portion generally partitioning the housing.

12. The LED luminaire of claim 11, wherein the reflector further comprises sidewall portions extending generally perpendicularly from the ends of the planar portion.

13. The LED luminaire of claim 11, wherein the LED light module comprises a circuit board with the plurality of LEDs mounted on the circuit board, and an imaginary line normal to the circuit board and passing through the center of the plurality of LEDs intersects the reflector.

14. The LED luminaire of claim 13, wherein the imaginary line intersects the reflector below a mid-point of the reflector.

* * * * *